US008590181B2

(12) United States Patent
Saba

(10) Patent No.: US 8,590,181 B2
(45) Date of Patent: Nov. 26, 2013

(54) IRON AND A METHOD THEREOF

(75) Inventor: Simon Saba, Manchester (GB)

(73) Assignee: Spectrum Brands (UK) Limited, Manchester (GB)

( * ) Notice: Subject to any disclaimer, the term of this patent is extended or adjusted under 35 U.S.C. 154(b) by 48 days.

(21) Appl. No.: 13/270,805

(22) Filed: Oct. 11, 2011

(65) Prior Publication Data

US 2012/0090204 A1 Apr. 19, 2012

(30) Foreign Application Priority Data

Oct. 15, 2010 (GB) ..... 1017449.8

(51) Int. Cl.

| | |
|---|---|
| ***D06F 75/36*** | (2006.01) |
| ***D06F 79/00*** | (2006.01) |
| ***F16L 3/00*** | (2006.01) |
| *B65H 75/24* | (2006.01) |

(52) U.S. Cl.
USPC ..... 38/94; 38/88; 248/51; 242/370

(58) Field of Classification Search
USPC ..... 38/74–77.83, 79, 88, 96; 68/222; 248/51, 52; 242/370
See application file for complete search history.

(56) References Cited

U.S. PATENT DOCUMENTS

| | | | | |
|---|---|---|---|---|
| 2,536,776 | A * | 1/1951 | Smellie | 99/385 |
| 2,786,287 | A * | 3/1957 | Swann | 38/77.4 |
| 2,802,288 | A * | 8/1957 | Hoecker | 38/77.5 |
| 2,893,045 | A * | 7/1959 | Dalbec | 15/323 |
| 4,459,771 | A * | 7/1984 | Ogata | 38/77.8 |
| 4,517,757 | A | 5/1985 | Asada et al. | |
| 4,585,194 | A * | 4/1986 | Schwob | 248/52 |
| 5,371,960 | A | 12/1994 | Wilson et al. | |
| 5,390,433 | A * | 2/1995 | Brady | 38/79 |
| 5,901,712 | A * | 5/1999 | St. Peter | 132/232 |
| 6,540,168 | B1 | 4/2003 | Archer et al. | |
| 6,942,080 | B2 * | 9/2005 | Chi | 191/12.4 |
| 7,062,870 | B1 * | 6/2006 | You | 38/88 |
| 7,343,703 | B2 * | 3/2008 | Giovalle et al. | 38/142 |
| 7,454,852 | B2 * | 11/2008 | Giovalle et al. | 38/142 |
| 2004/0050837 | A1 | 3/2004 | Bontems et al. | |
| 2005/0121276 | A1 | 6/2005 | Chi | |

FOREIGN PATENT DOCUMENTS

| | | | |
|---|---|---|---|
| DE | 81 15 797.5 | U1 | 8/1981 |
| DE | 38 43 384 | A1 | 7/1990 |
| EP | 1 038 821 | A2 | 9/2000 |
| EP | 2 025 804 | A1 | 2/2009 |
| GE | 2 391 556 | A | 2/2004 |

OTHER PUBLICATIONS

British Search Report issued in British Application No. GB1017449.8 dated Feb. 2, 2011.
Feb. 7, 2012 Search Report issued in European Patent Application No. 11 184 811.5.

* cited by examiner

*Primary Examiner* — Ismael Izaguirre
(74) *Attorney, Agent, or Firm* — Oliff & Berridge, PLC

(57) ABSTRACT

An electrical iron comprising: a body; a connector; a cord being connected at a first point to the body and being connected at a second point to the connector; a receiving means that is mounted on the body, and is suitable for receiving the connector, wherein the receiving means includes a means for adjusting the tension the in cord.

22 Claims, 7 Drawing Sheets

IRON AND A METHOD THEREOF

FIELD OF INVENTION

The present invention relates generally to electrical irons. More specifically, the present invention relates to electrical irons that have an attached electrical cord.

BACKGROUND OF INVENTION

Electrical irons that have an electrical cord are well-known. The electrical cord is flexible and includes a plug, an electrical conductor and a protective cover. The protective cover is arranged around the electrical conductor. In use the plug is connected to a power supply to electrically connect the electrical iron to the power supply via the cord.

When storing the electrical iron it is well-known to wind the cord around a body of the iron. However, when wound, if the cord is not secured the winding may become loose. A loose winding is unsightly and may become tangled in the storage area. Furthermore, the loose winding may permit the cord to unwind further from the body. An unwound cord presents a potential safety hazard. Also, during transportation of the iron, the cord may become trapped causing damage to the protecting cover.

It is an objective of the present invention to overcome at least one of the above or other problems. More particularly, the objective is to provide a means for storing securely a cord with an electrical iron.

SUMMARY OF THE INVENTION

According to the present invention there is provided an improved electrical iron, and method as set forth in the appended claims. Other optional features of the invention will be apparent from the dependent claims and the description.

According to an aspect of the present invention there is provided an electrical iron with a body; a connector; a cord and; a receiving means. The cord being connected at a first point to the body and being connected at a second point to the connector. The receiving means being mounted to the body. The receiving means being suitable for receiving the connector. The receiving means including a means for adjusting the tension in the cord. Advantageously the cord can be tightened to avoid loose sections of cord that are unsightly and may become tangled in the storage area.

The means for adjusting the tension in the cord comprising a movably mounted receiving means. Advantageously, the connector when received by the receiving means can be moved such that the cord is tightened.

The movably mounted receiving means is movable relative to a fixed point on the cord. Advantageously, when moving the receiving means, the distance between the fixed point on the cord and the receiving means is altered, thereby changing the tension in the cord.

In one example the fixed point on the cord may be positioned at the first point on the cord. Advantageously, the length of the cord between the first point and second point can be adjusted when the receiving means is moved.

In another example, a length of cord is arrangeable in a stowed position, and the fixed point on the cord is located on the length of cord when stowed. Advantageously, a section of cord between the stowed length and second point can be tightened when the receiving means is moved.

The receiving means may be rotatably mounted to the body of the electrical iron. Advantageously, movement of the receiving means is effected by rotation about an axis, the rotatable movement being compact.

Optionally, the rotatable mount of the receiving means includes a means for resisting rotation. Advantageously the cord, when tightened by moving the receiving means, can remain tight due to the means for resisting rotation.

In one example the means to resist rotation is a ratchet mechanism. In another example the means to resist rotation is one or more opposed surface such that friction between the surfaces resists rotation. Advantageously, both means to resist rotation can be incorporated cheaply and compactly around the receiving means.

Optionally, the body includes an neck region suitable for stowing the cord in a stowed position. Advantageously, the cord can be stowed together with the electrical iron.

In one example, the cord is coiled around the neck region when in a stowed position. Advantageously, the cord is easily and quickly stowed by coiling around the neck region.

The receiving means may include a male or female socket for receiving the connector. Advantageously, the connector can be located on the receiving means by insertion into the socket.

Optionally the socket includes one or more apertures suitable for receiving one or more prongs of the connector. Advantageously, the connector can be located on the receiving means by inserting the prongs of the connector into the apertures.

The apertures may include one or more restraints arranged to grip the one or more prongs of the connector. Advantageously, the connector can be secured in the receiving means by engaging the prongs of the connector with the restraints of the apertures.

In one example the receiving means is moved manually by a user. Advantageously, the user can manually move the receiving means until the correct tension in the cord is achieved. In another example the receiving means is actuated by an assisted means. Advantageously, the assisted means moves the receiving means until the correct tension in the cable is achieved. Here the assisted means may be an electric motor.

Optionally, the receiving means includes a recess suitable for recessing the connector. Advantageously, the connector when received by the receiving means can be recessed within the recess. Consequently, the connector can be stored in a more compact and aesthetically acceptable way. Furthermore, the connector can be recessed such that it does not protrude beyond the body of the electrical iron, thereby enabling the electrical iron to be stood on a surface comprising the recessed connector.

The recess may be movable between an exposed and recessed position. Advantageously, the connector can be conveniently located on the recess when in the exposed position, then moved with the recess into the recesses position.

Optionally, the recess may be biased to either the exposed position or recessed position by means of a spring. Advantageously, a user need only actuate the recess to one of the exposed or recessed positions.

The receiving means may be positioned at a heel region of the electrical iron. Advantageously, the receiving means can be incorporated into the body of an existing electrical iron without substantially changing the geometry of the body and without substantially increasing the usage of material.

Optionally the heel of the electrical iron includes one or more cut-outs suitable for receiving the cord. Advantageously, when locating the connector in the receiving means the cord can be inserted into the cut-outs. Consequently, the inserted cord does not protrude beyond the body of the electrical iron, thereby enabling the electrical iron to be stood on the heel.

Optionally, the electrical iron includes a storage means to removably stow a funnel. Advantageously a funnel can be stowed with the electrical iron to prevent the funnel from becoming lost.

According to a further aspect of the present invention there is provided a kit of parts comprising a funnel and an electrical iron the electrical iron including: a body; a connector; a cord; a receiving means, and; a storage means to removably stow a funnel. The cord being connected at a first point to the body and being connected at a second point to the connector.

The receiving means being suitable for receiving the connector. The receiving means being mounted on the body such that it is movable in order to adjust tension in the cord.

According to a further aspect of the present invention there is provided a method of storing a cord with an electrical iron. The method comprising: adjusting the tension in the cord by moving a receiving means which is mounted on a body of the electrical iron. The receiving means being suitable for receiving the connector. The cord being connected at the first point to the body of the appliance and being connected at a second point to the connector.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION OF THE EXEMPLARY EMBODIMENTS

Figure 1:
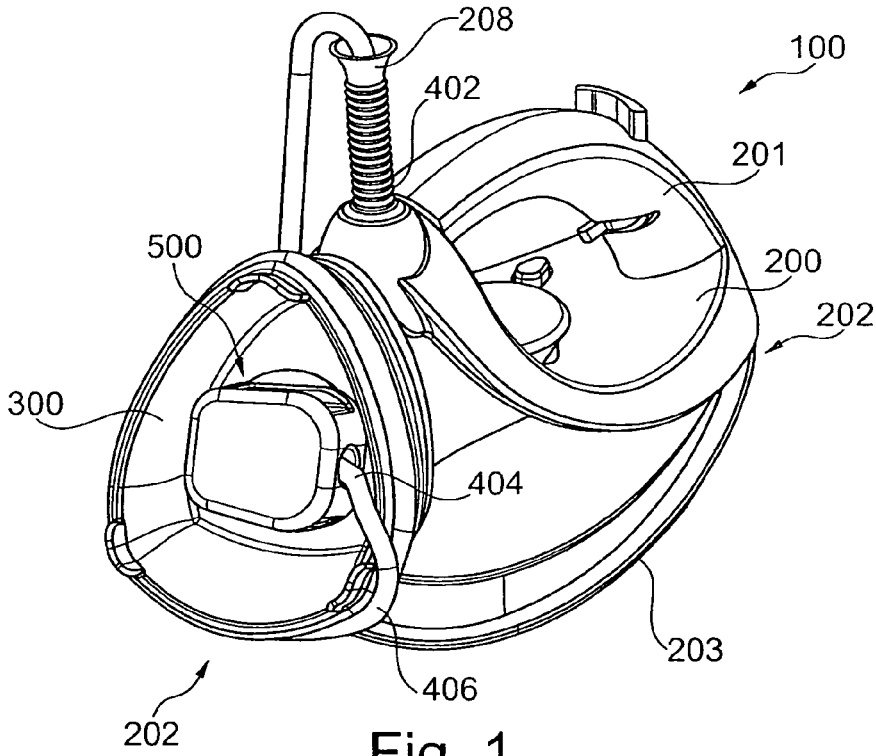
FIG. 1 is an isometric view showing an electrical iron according to the present invention.

FIG. 1 is an isometric view of an electrical iron 100 as provided in an example embodiment. The electrical iron 100 includes a body 200, a connector 300 a cord 400 and a receiving means 500 for receiving the connector 300. The cord 400 is connected at a first point 402 to the body 200. The cord 400 is further connected at a second point 404 to the connector 300. The receiving means 500 is mounted on the body 200 such that it is movable in order to adjust the tension in the cord 400, which is discussed in detail below.

Figure 2:
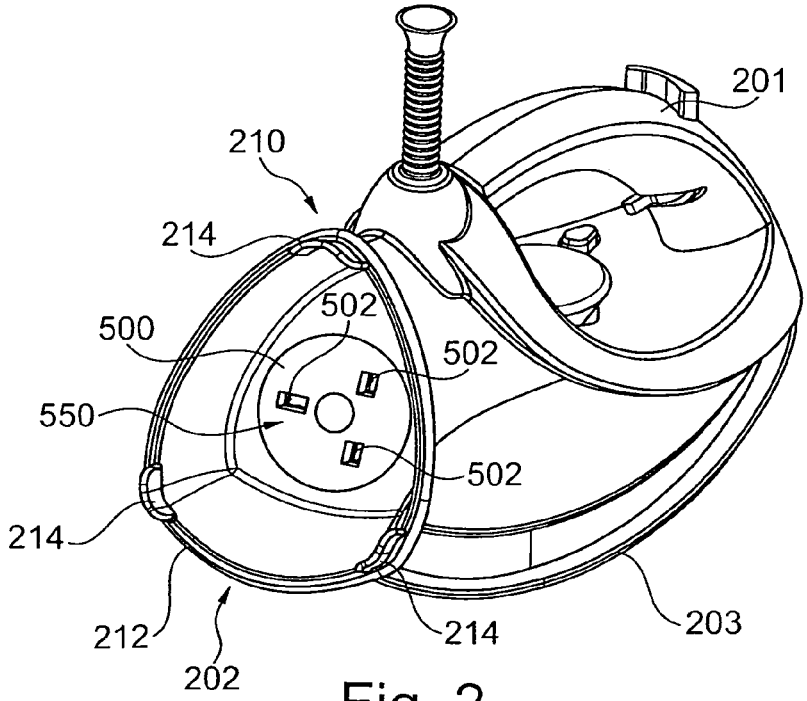
FIG. 2 is an isometric view, similar to FIG. 1, but with the cord and electrical connector removed.

FIG. 2 is an isometric view showing the receiving means 500 in more detail. The receiving means 500 comprises a means suitable for receiving the connector 300 such as a plug socket. In this example the receiving means 500 comprises a socket 550 for receiving a three pronged connector and is circular in shape. In another example the receiving means 500 may comprise one or more prongs for insertion into a socket on the connector 300.

Referring back to FIG. 1 the connector 300 comprises a means suitable to electrically connect the cord 300 to a power source. Here the connector 300 is a three pronged connector suitable for insertion into the socket of a mains electricity supply. The cord 400 is flexible and comprises a protective cover and an electric conductor. The protective cover is arranged around the electrical conductor. The body 200 includes an exterior surface of the electric iron 100 and may be fabricated from one or more components.

Referring back to FIG. 2 the socket 550 of the receiving means 500 includes a number of apertures 502. The apertures are arranged to receive the prongs of the connector 300. The shape and depth of the apertures 502 may be varied to accommodate different shapes of prong. In this example there are three apertures 502 arranged to receive the prongs of a three pronged connector 300. In another example there are two apertures 502 arranged to receive the prongs of a two pronged connector 300. It will be appreciated that the number and location of the apertures 502 is varied to fit a range of different connectors.

Figure 3:
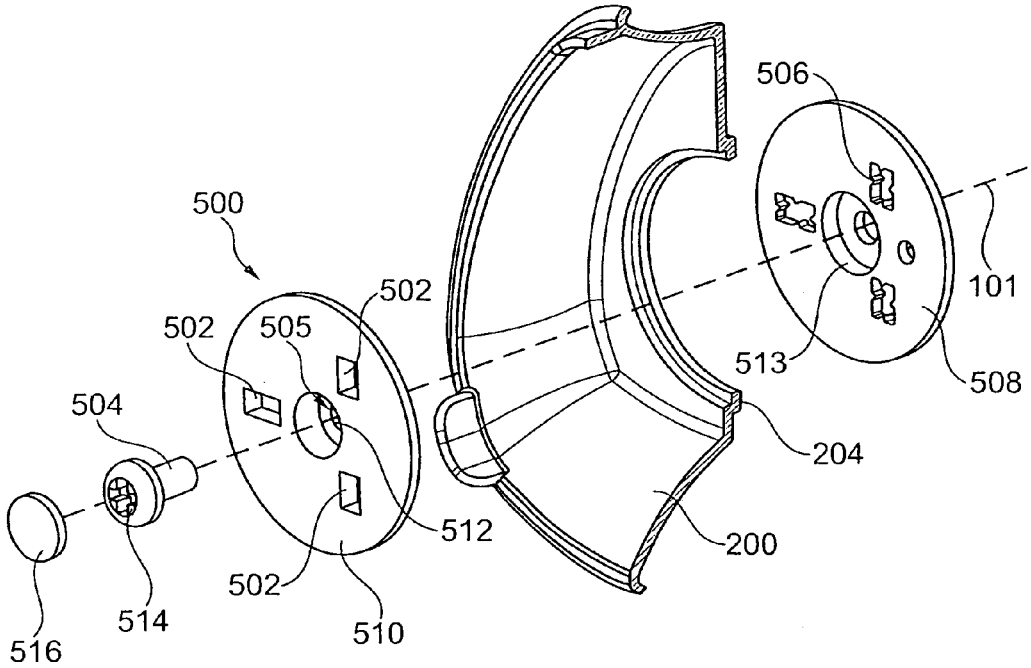
FIG. 3 is an enlarged, exploded, cut-away view showing the assembly of the receiving means of the electrical iron of FIG. 1.

FIG. 3 is an exploded view showing the assembly of the receiving means 500 and associated components in more detail. Here the receiving means 500 is rotatably attached to a heel region 202 (FIG. 1) of the base 200. The heel region 202 comprises a region positioned towards the rear of a handle 201 and an element 203. The receiving means 500 is rotatably mounted about an axis 101 by means of a pin 504. In this example the pin 504 is a screw. The pin 504 is inserted through an axial hole 505 in the receiving means 500 and into the base 200 of the electrical iron 100.

In this example the apertures 502 include one or more restraints 506. The restraints 506 comprise a shape that protrudes outwardly into the aperture 502 and may be in the form of a ridge or a curve shape. Here there are four restraints 506 per aperture. The restraints 506 are arranged to grip the prongs of the connector 300 when the prongs of the connector are inserted into the apertures 502. Advantageously, the connector 300 is held securely in the receiving means 500 by the restraints 506 gripping the prongs of the connector 300.

The receiving means 500 may be formed integrally or from several components. Here the receiving means includes a separate rear plate 508 and a front plate 510. The apertures 502 may run through the rear plate 508 and/or the front plate 510. Here the restraints 506 are positioned on the rear plate 508, however the restraints 508 may also be positioned on the front plate 510.

The receiving means 500 includes a recess 512 for receiving a head 514 of the pin 504. The head 514 of the pin 504 when received sits level with the outer face of the front plate 510. Advantageously, the prongs can be fully inserted into the apertures 502. A pin cap 516 is positioned over the head of the pin 504 when received. Advantageously, the cap 516 restrains the pin 504, from separating from the body 200 of the electrical iron 100. Furthermore, the cap 516 can be used to conceal the pin 504, and thereby prevent dirt from accumulating in the recess. The recess 512 protrudes into a second recess 513 positioned in the rear plate 508. Advantageously mating of the recesses enables the front plate 510 to be located on the rear plate 508.

The body 200 of the electrical iron 100 includes a rim 204. In use the rim 204 abuts a surface of the receiving means 500 and can be used to locate the receiving means 500 on the body of the electrical iron 200. Advantageously, friction between the rim 204 and the receiving means 500 prevents free rotation of the receiving means 500. Alternatively or additionally friction between the pin 504 and receiving means 500 prevents free rotation of the receiving means 500.

Figure 4:
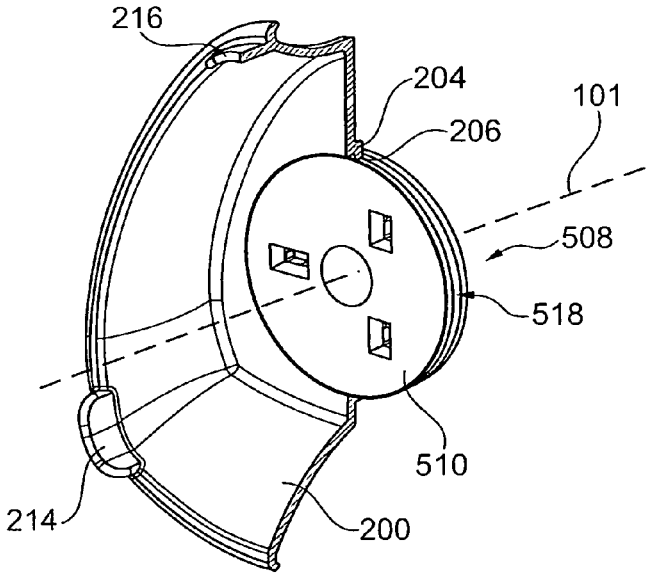
FIG. 4 is an isometric view showing a rim of the electrical iron of FIG. 1.

FIG. 4 is an isometric view showing the rim 204 in more detail. Here the rim 204 includes an L-shaped section 206, and the receiving means 500 further includes a channel 518 suitable for receiving the L-shaped section 206. The channel 518 is formed between the front plate 510 and rear plate 508. The L-shaped section 206 and channel 518 when mated locate the receiving means 500 on a plane normal to the axis 101 of the rotation and restrains translational movement of the receiving means 500 in a direction parallel to the axis of rotation 101. Advantageously, the frictional force between the receiving means 500 and rim 204 can be adjusted by altering the torque of the pin 504. Additionally, the receiving means 500 is held in place by the rim 204 and so will not separate from the body of the electrical iron 200 and become lost.

Optionally the rim 204 is formed from two or more components. The components can be assembled together to clasp the receiving means 500. The receiving means 500 can be rotated relative to the body 200 of the electrical iron 100 either by hand or with an assisted means such as an electric motor. In one example the rotation of the receiving means maybe restrained in one or more directions using a ratchet mechanism (not shown). Here the receiving means includes a pawl suitable for engaging a spring loaded ratchet positioned on the body 200. Advantageously, the ratchet mechanism can be used to lock the receiving means in certain positions.

The receiving means 500 is moveably attached to the base 200 of the electrical iron 100 such that the receiving means 500 can be located in an exposed position and in a recessed position. In one example the movable attachment is provided by a channel into the base 200 and a rim connected to the receiving means 500. Here the channel engages the rim to permit translational movement of the receiving means 500 relative to the base 200. Advantageously, the connector 300 can be inserted into the receiving means 500 when in the exposed position, and then recessed into the body 200 by moving the receiving means 500 to the recessed position. In the recessed position the connector 300 does not extend beyond the body 200, thereby saving space and maintaining a flat surface suitable for resting the electrical iron upon. Optionally, receiving means 500 may be spring loaded such that it is biased towards either the exposed or recessed position. There may also be included a locking mechanism to lock the receiving means 500 in one or both of the exposed and recessed positions. Advantageously, the receiving means 500 can be moved between one of the exposed or recessed positions by actuating the locking mechanism.

Referring back to FIG. 1 the first point 402 of the cord is positioned on top of the body 200 of the electrical iron 100 near the handle 201. However, the first point 402 of the cord 400 may be positioned elsewhere on the body 200 of the electrical iron 100. Here the first point 402 of the cord 400 is flexibly mounted to, and is diverted away from, the body 200 of the electrical iron 100 by means of a spring 208.

Referring back to FIG. 2 the heel region 202 of the electrical iron may further include a neck region 210. The neck region 210 comprises any region suitable for coiling the cord 400 around such that the cord may by stowed in a stowed position. The stowed position comprises a coiled section of cord. At one end the neck region 210 expands to include a heel 212 of the electrical iron 100. At the other end the neck region 210 expands to include the handle 201 and the element 203. The length and cross section of the neck region 210 are such that the length of the cord 400 between the first point 401 and second point 402 may be coiled around the neck region 201. Advantageously, the cord 400 when coiled around the neck region 210 is prevented from slipping off the neck region 210 by the heel 212, handle 201 and element 203.

Referring back to FIG. 2, the cable 400 can be inserted through the gaps between a number of feet 214. Advantageously, the cord 400 can be positioned between the feet when fixing the connector 300 into the receiving means 500. Advantageously, the cord 400 does not extend beyond the heel 212 and the electrical iron can be stood securely on the heel 212.

Figure 5:
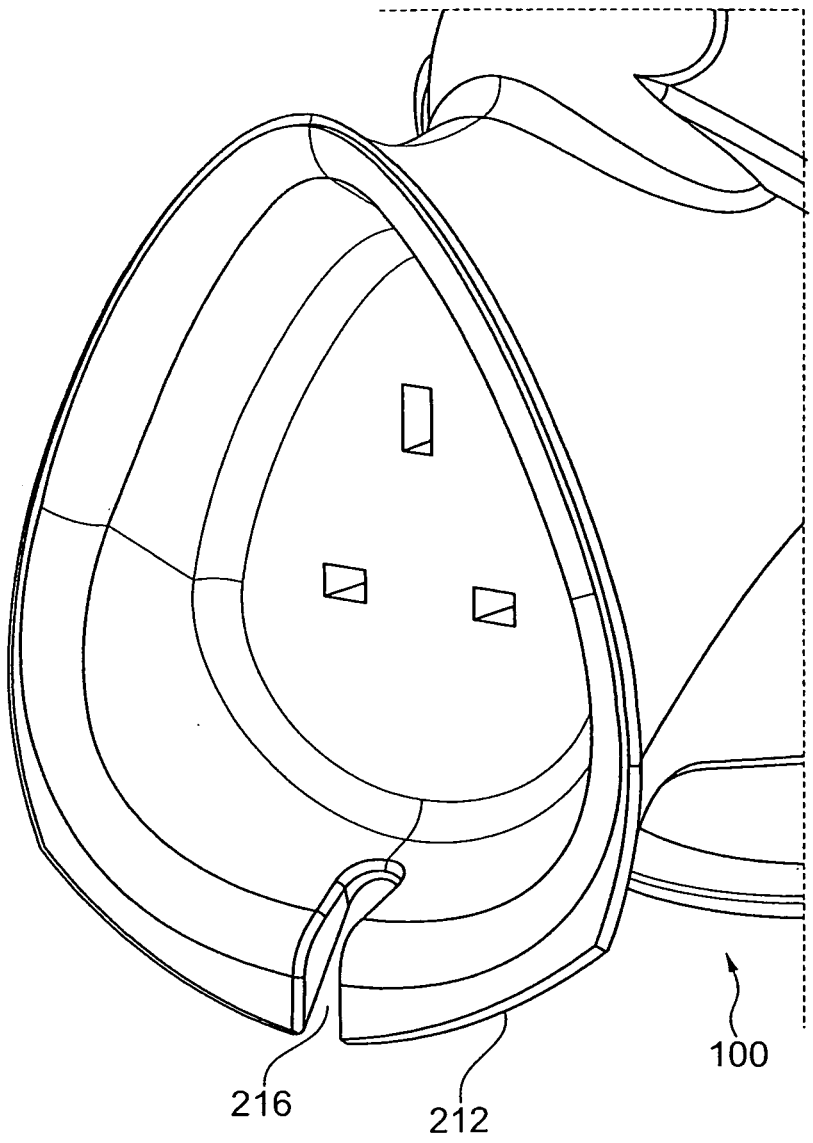
FIG. 5 is an isometric view showing an additional embodiment of a heel of an electrical iron according to the present invention.

FIG. 5 shows an isometric view of the heel 212 of the electrical iron according to an alternative embodiment. Optionally, the heel 212 of the electrical iron 100 includes a cut-out 216. The cut-out 216 comprises a channel in the heel suitable for receiving the cord 400. Advantageously, the cord 400 can be inserted through the cut-out when fixing the connector 300 into the receiving means 500. Advantageously, the cord 400 does not extend beyond the heel 212 and the electrical iron can be stood securely on the heel 212.

Figure 6:
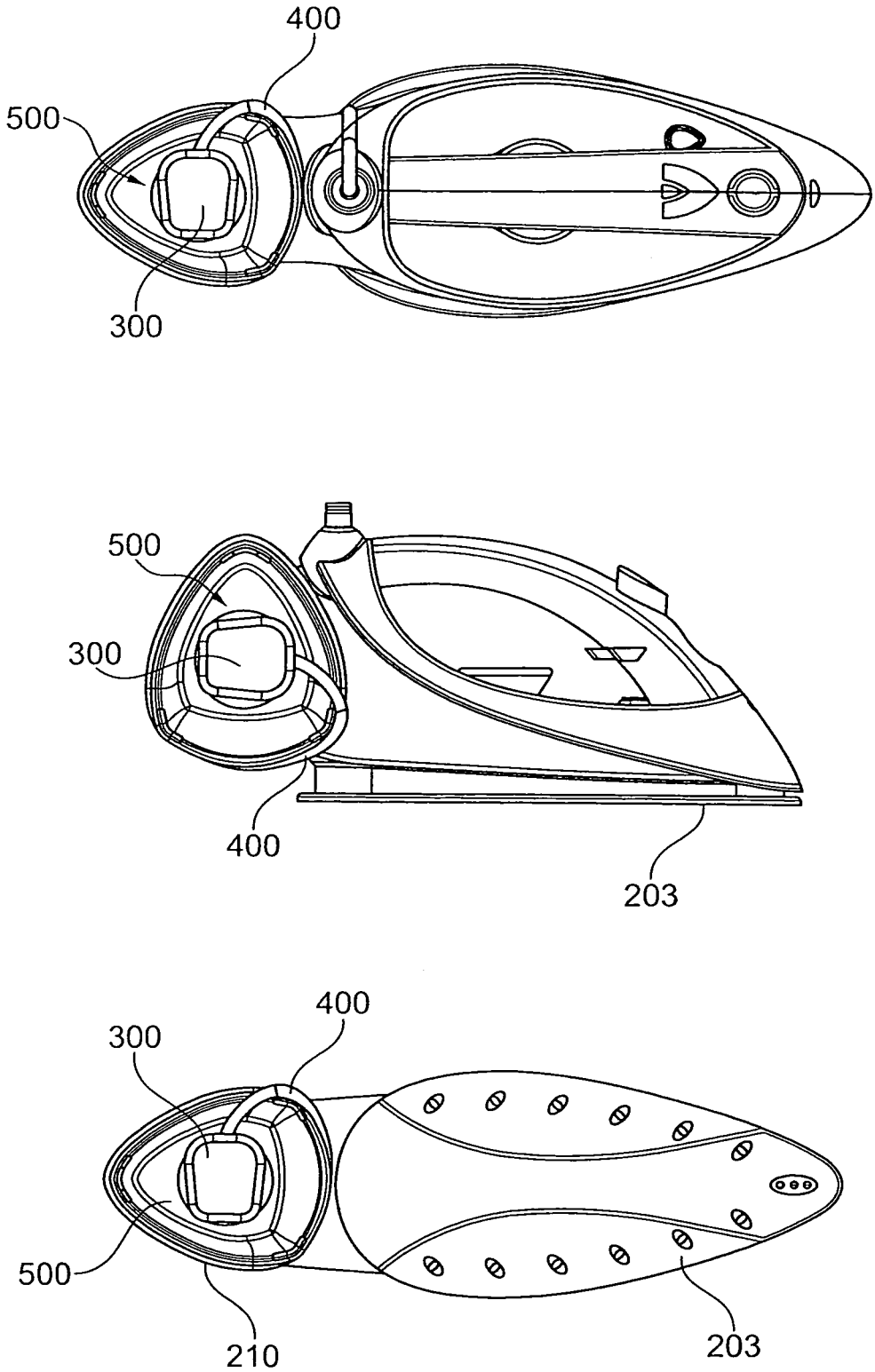
FIG. 6 are isometric views showing additional embodiments of the electrical iron according to the present invention.

FIG. 6 shows additional embodiments where the receiving means 500, neck region 210 and other associated components are placed at different locations on the body 200 of the electrical iron 100. For instance, the neck region 210 may be positioned such that the cord 400 is coiled in substantially the same plane as the element 203 of the electrical iron 100 and the receiving means 500 is positioned such that the connector 300 is inserted via the top of the electrical iron 100. Alternatively, the neck region 210 may be positioned such that the cord 400 is coiled in a plane substantially normal to the element 203 of the electrical iron and the receiving means 500 is positioned such that the connector 300 is inserted into the side of the electrical iron 100. Alternatively, the neck region may be positioned such that the cord 400 is coiled in a plane substantially parallel to the element 203 of the electrical iron 100 and the receiving means 500 is positioned such that the connector 300 is inserted into the bottom of the electrical iron 100.

Referring back to FIG. 1, to take-up the cord 400, initially the cord 400 is coiled around the neck region 210. The coil is initiated at a position near the first point 402 and continued towards the second point 404 of the cord 400. Prior to the second point 404 of the cord being coiled around the neck region 210, the coil is terminated such that there is sufficient length of cord 400 between the termination point 406 and the second point 404 to enable the connector 300 to be inserted into the receiving means 500. Thereafter, the receiving means 500 is rotated until the length of coil between termination point 406 of the coil 400 and the second point 404 of the coil 400 is held under sufficient tension to prevent sections of coil unwinding from the neck. Thereafter, the receiving means maybe prevented from rotating by means of friction or a ratchet mechanism as discussed previously. Advantageously the coil can not loosen accidentally from the neck region 201.

To take-out the cord 400, initially the receiving means 500 is rotated to reduce the tension in the cable 400 between the second point 404 and the termination point 406. Thereafter, the connector 300 is removed from the receiving means 500 and the coil can be unravelled from the neck region 210.

Figure 7:
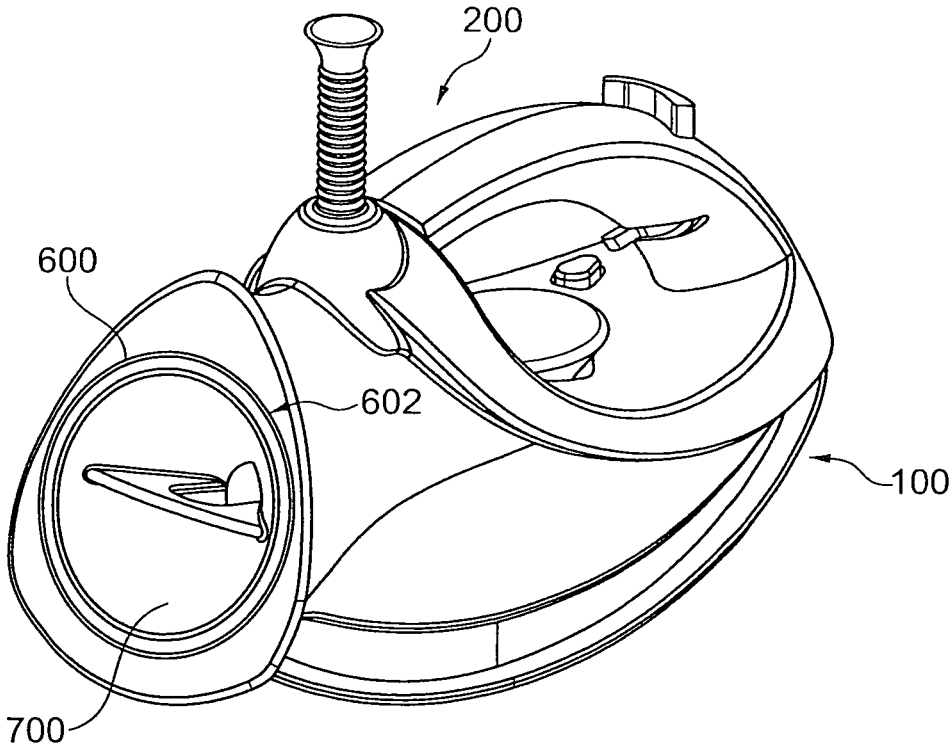
FIG. 7 is an isometric view showing an electrical iron including a funnel according to the present invention.

FIG. 7 is an isometric view of an electrical iron 100. The body 200 of the electrical iron 100 includes a storage means 600 to removably stow a funnel 700. Advantageously, the funnel 700 can be stowed with the electrical iron 100 to prevent the funnel 700 from becoming lost.

The storage means 600 comprises any means suitable for removably attaching the funnel 700 to the body 200 of the electrical iron 100. In this example the storage means includes a cavity 602 that the funnel 700 can be stowed within. However, in another example the funnel need not be stowed within a cavity.

Figure 8:
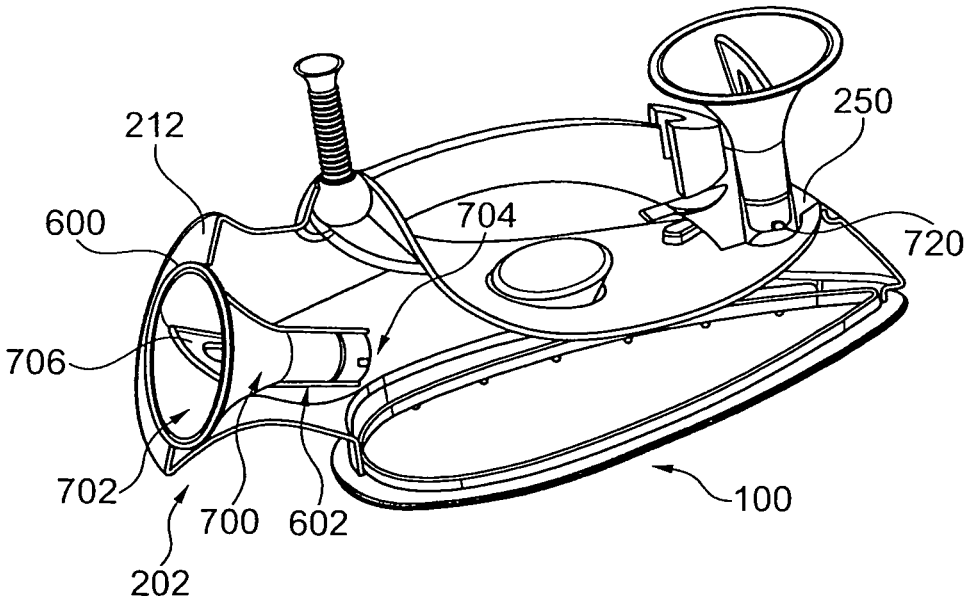
FIG. 8 is a cut-away isometric view showing the electrical iron and funnel according to the present invention.

FIG. 8 is an isometric view showing the storage means 600 and funnel 700 in more detail. In this example the storage means 600 is positioned in the heel region 202 of the body 200 of the electrical iron 100. In another example the storage means 600 may be positioned elsewhere on the body 200 of the electrical iron 100.

Advantageously, in this example, the funnel 700 when stowed sits level to, or is concealed within, the cavity 602. In this way the funnel 700 or heel 212 of the electrical iron 100 may provide a surface to rest the electrical iron 100 upon. Advantageously, by positioning the cavity 602 in the in the heel region 202 of the electrical iron 100 the funnel 700 can be stowed compactly without substantially changing the geometry of the electrical iron. Consequently, the storage means 600 can be incorporated in an electrical iron without a substantial increase in material usage.

The funnel 700 comprises a means for channelling water through a mouth region 702 into a stem region 704. The mouth region 702 has a large cross-sectional area and the stem region 704 has a reduced cross-sectional area. The funnel includes a finger grip 706. The finger grip comprises a substantially flat surface positioned within the mouth region 704, that can be gripped by a user to manipulate the position on the funnel 700. Advantageously, the finger grip 706 can be gripped by the user to remove the funnel 700 from the storage means 600. The funnel 700 further includes one or more breather holes 750 (not shown). The breather holes 750 comprise separate passageways through the funnel 700. Advantageously, the breather holes 750 enable air outflow through a passage way separate to water inflow when refilling a reservoir within the electrical iron 100. The geometry of the mouth region 702 and stem region 704 of the funnel 600 may encompass a wide-range of variations known in the art all of which are capable of being stowed by the storage means 600.

Figure 9:
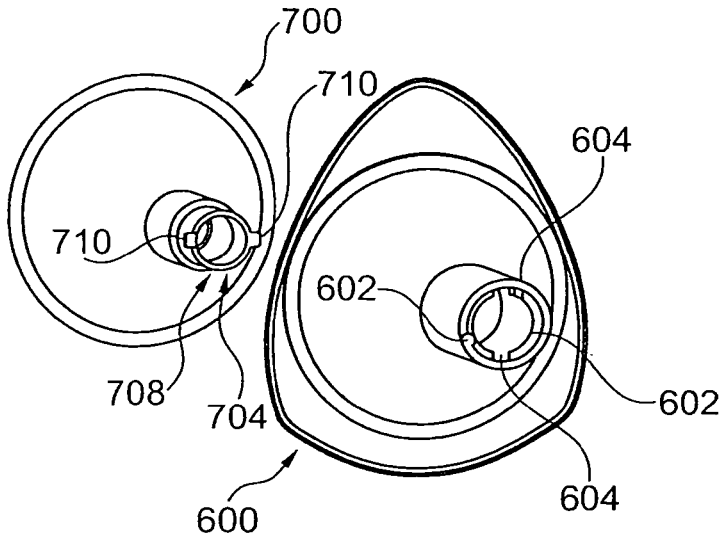
FIG. 9 is an enlarged isometric view of the funnel shown in FIG. 7.

FIG. 9 shows the funnel 700 in more detail. Here the funnel 700 is attached to the storage means 600 by a securing means 708. The securing means 708 comprises any means to securely attach the funnel 700 to the storage means 600. In this example the securing means 708 comprises a bayonet fitting, which includes one or more outwardly extending latches 710 positioned on the stem region 704 of the funnel 700. The storage means 600 includes one or more catches 602 for receiving the latches 710. In use the stem 704 of the funnel 700 is inserted into the storage means 600 such that the latches 710 pass through gaps 604 in the catches 602. Thereafter, the funnel 700 is rotated such that the latches 710 are engaged with the catches 604. Advantageously, the funnel can be secured to the body 200 of the electrical iron 100 using the securing means 708, thereby preventing the funnel 700 from separating from the electrical iron. To remove the funnel 700 from the securing means 708, the funnel 700 is rotated to disengage the latches 710 from the catches 602. Thereafter, the funnel can be removed by retracting the latches 710 through the gaps 604. Advantageously, the funnel 700 can be manipulated during the above operations using the finger grip 706.

Figure 10:
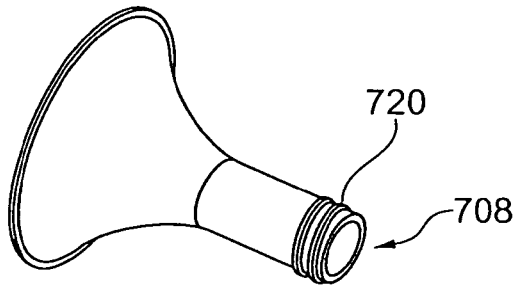
FIGS. 10 to 11 are enlarged isometric views of additional embodiments of a funnel according to the present invention.

FIG. 10 shows an alternative securing means 708 in more detail. In this example the securing means 708 comprises a screw fitting. Here the funnel 700 is secured to the storage means 600 by engaging a male thread 720 on the funnel 700 with a female thread on the storage means 600.

Figure 11:
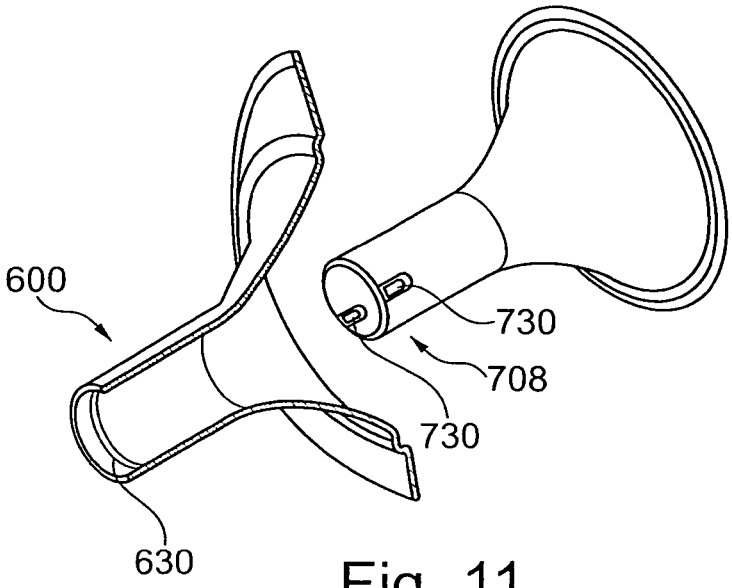

FIG. 11 shows an alternative securing means 708 in more detail. In this example the securing means 708 comprises a clip fitting. Here the funnel 700 is secured to the storage means 600 by engaging one or more outwardly extending protrusions 730 on the funnel 700 with a recess 630 on the storage means 600. The protrusions 730 may be elastically supported or made from an elastic material to facilitate their insertion into the recess.

The securing means 708 may further include a tight fitting stem 704 and storage means 600, such that the funnel 700 is held in place by friction.

Referring back to FIG. 8, the body 200 of the electrical iron further includes and orifice 250. The orifice 250 comprises an inlet with a small cross-sectional area for filling the electrical iron 100 with water. Optionally, the orifice 250 includes a second securing means 720 for securing the funnel 700. The second securing means 720 comprises any means to securely attach the funnel 700 to the orifice 250. Advantageously, the funnel 700 may be secured to the orifice 250 when filling the electrical iron. Here the securing means 708 and second securing means 720 comprise the same fitting. Consequently, the funnel can be secured to the storage manes 600 orifice 250 by using the same operation.

To fill the electrical iron 100 the funnel 700 is removed from the storage means 600 by disengaging the securing means 708. Thereafter, the funnel 700 is secured to the orifice 250 by engaging the second securing means 720 and the electrical iron 100 can be filled. After filling the electrical iron 100, the funnel 700 is disengaged from the second securing means 720. The funnel 700 is then secured to the storage means 600 by engaging the securing means 708.

Figure 12:
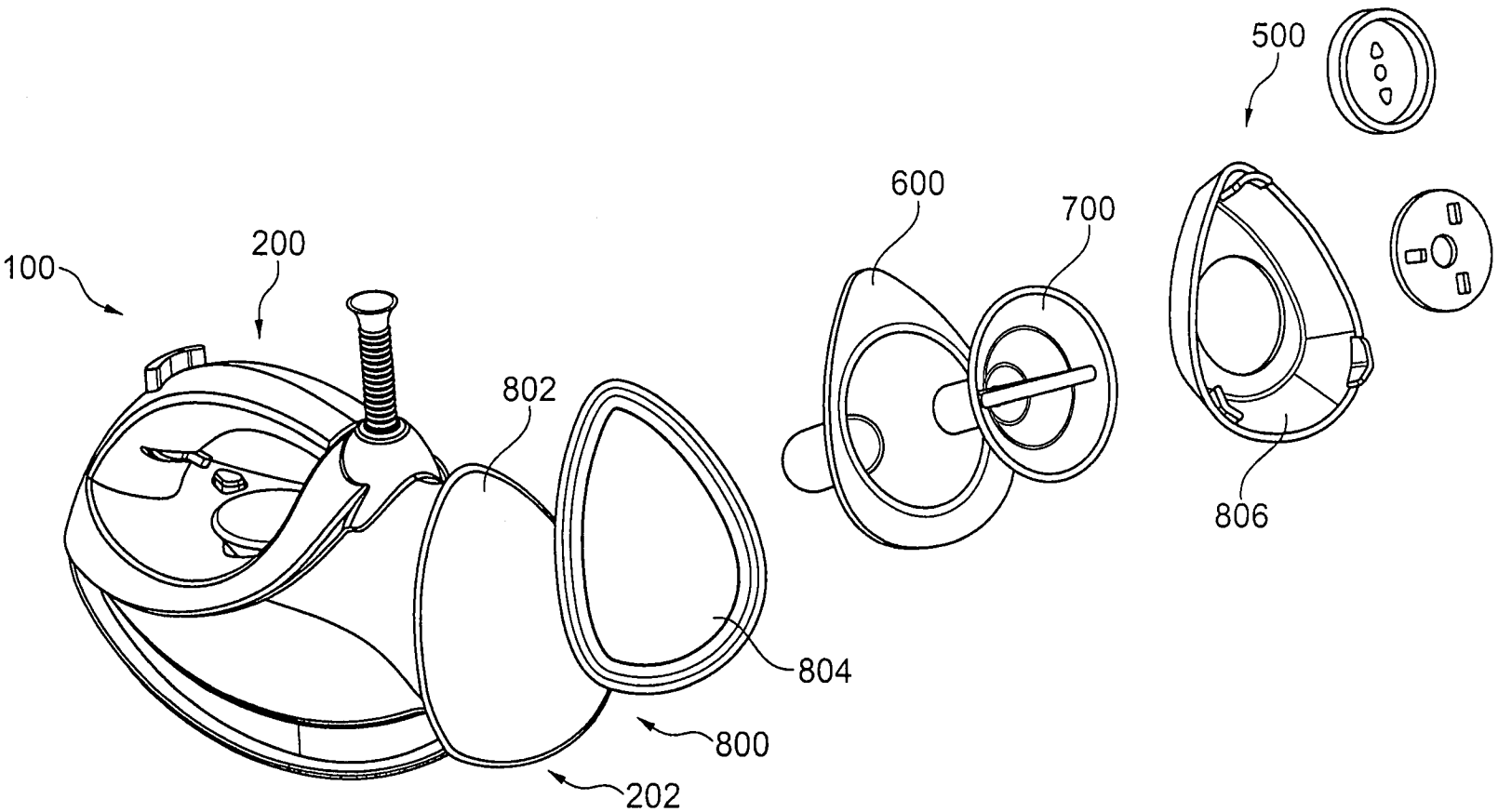
FIG. 12 is an exploded isometric view showing a modular attachment for an electrical iron according to the present invention.

FIG. 12 shows a modular fitting 800 for an electrical iron 100. In this example the modular fitting 800 is positioned in the heel region 202 of the body 200 of the electrical iron 100. However, the modular fitting 800 can be positioned elsewhere on the body 200 of the electrical iron 100. The modular fitting comprises a container 802 that enables a range of configurations for the electrical iron 100. In one example the container 802 may be configured to be sealed with a blanking plate 804. In a further example the container 802 may be configured to comprise a storage means 600 to removably stow a funnel 700. In a yet further example the container 802 may be configured to comprise a receiving means 500 and support plate 806 for storing a connector 300 and cable 400.

Although preferred embodiments(s) of the present invention have been shown and described, it will be appreciated by those skilled in the art that changes may be made without departing from the scope of the invention as defined in the claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An electrical iron comprising:

a body;

a connector;

a cord being connected at a first point to the body and being connected at a second point to the connector;

a receiving means that is mounted on the body, and is suitable for receiving the connector, the receiving means including a means for adjusting the tension the in cord, wherein the receiving means includes a recess suitable for receiving the connector, the recess being movable between an exposed and recessed position.

2. A kit of parts comprising:

a funnel, and;

an electrical iron, the electrical iron including:

a storage means to removably stow a funnel;

a body;

a connector;

a cord being connected at a first point to the body and being connected at a second point to the connector;

a receiving means that is mounted on the body, and is suitable for receiving the connector;

wherein the receiving means is movable in order to adjust tension in the cord.

3. The kit of parts according to claim 2, wherein the means for adjusting the tension in the cord includes a movably mounted receiving means.

4. The kit of parts according to claim 3, wherein the movably mounted receiving means is movable relative to a fixed point on the cord.

5. The kit of parts according to claim 4, wherein the fixed point on the cord is positioned at the first point on the cord.

6. The kit of parts according to claim 4, wherein a length of cord is arrangeable in a stowed position and the fixed point on the cord is located on the length of cord when stowed.

7. The kit of parts according to claim 6, wherein the rotatably mounted receiving means includes a means for resisting rotation.

8. The kit of parts according to claim 2, wherein the receiving means is rotatably mounted to the body of the electrical iron.

9. The kit of parts according to claim 8, wherein the means to resist rotation is a ratchet mechanism or one or more opposed surface such that friction between the surfaces resists rotation.

10. The kit of parts according to claim 2, wherein the body includes a neck region suitable for stowing the cord in a stowed position.

11. The kit of parts according to claim 10, wherein the stowed position is a coil.

12. The kit of parts according to claim 11, wherein the apertures include one or more restraints arranged to grip the one or more prongs of the connector.

13. The kit of parts according to claim 2, wherein the receiving means includes one or more apertures suitable for receiving one or more prongs of the connector.

14. The kit of parts according to claim 2, wherein the receiving means is operable to be moved manually by a user or is operable to be actuated by an assisted means.

15. The kit of parts according to claim 2, wherein the receiving means includes a recess suitable for receiving the connector.

16. The kit of parts according to claim 15, wherein the recess is movable between an exposed and recessed position.

17. The kit of parts according to claim 16, wherein the recess is biased to either the exposed position or recessed position by means of a spring.

18. The kit of parts according to claim 17, wherein the heel of the electrical iron includes one or more cut-outs suitable for receiving the cord.

19. The kit of parts according to claim 2, wherein the receiving means is positioned at a heel region of the electrical iron.

20. The kit of parts according to claim 2, wherein the electrical iron includes a storage means to removably stow a funnel.

21. A method of storing a cord with an electrical iron, the method comprising:

adjusting the tension in the cord by moving a receiving means which is mounted on a body of the electrical iron, the receiving means being suitable for receiving the connector, the cord being connected at the first point to the body of the appliance and being connected at a second point to the connector, wherein the electrical iron includes a storage means to removably stow a funnel.

22. The method as claimed in claim 21, wherein the electrical iron further comprises:

a body;

a connector;

a cord being connected at a first point to the body and being connected at a second point to the connector;

a receiving means that is mounted on the body, and is suitable for receiving the connector, wherein the receiving means includes a means for adjusting the tension the in cord.

* * * * *